US006966586B2

(12) United States Patent
Herth et al.

(10) Patent No.: US 6,966,586 B2
(45) Date of Patent: Nov. 22, 2005

(54) FITTING

(75) Inventors: Holger Herth, Bad Salzuflen (DE); Oliver Link, Bad Salzuflen (DE); Georg Kaluza, Velbert (DE)

(73) Assignee: DORMA GmbH + Co. KG, Ennepetal (DE)

( * ) Notice: Subject to any disclaimer, the term of this patent is extended or adjusted under 35 U.S.C. 154(b) by 77 days.

(21) Appl. No.: 10/381,127

(22) PCT Filed: Sep. 20, 2001

(86) PCT No.: PCT/EP01/10898

§ 371 (c)(1),
(2), (4) Date: May 22, 2003

(87) PCT Pub. No.: WO02/25045

PCT Pub. Date: Mar. 28, 2002

(65) Prior Publication Data

US 2004/0037632 A1 Feb. 26, 2004

(30) Foreign Application Priority Data

Sep. 22, 2000 (DE) ..... 100 47 557
Sep. 22, 2000 (DE) ..... 100 47 558
Sep. 22, 2000 (DE) ..... 100 47 559
Mar. 28, 2001 (DE) ..... 201 05 539 U

(51) Int. Cl.[7] ..... E05B 15/02

(52) U.S. Cl. ..... 292/357; 292/348; 292/349; 292/353; 292/DIG. 53; 70/452

(58) Field of Search ..... 292/357, 336.3, 292/348, 356, DIG. 53, 349, 353, DIG. 64; 70/452, 466, 448; 16/421, 422

(56) References Cited

U.S. PATENT DOCUMENTS 556,587 A * 3/1896 Noack ..... 292/349
653,693 A * 7/1900 Parker ..... 292/357
682,000 A * 9/1901 Taylor ..... 292/349
702,831 A * 6/1902 Thompson ..... 70/452
868,235 A * 10/1907 Voight ..... 70/447
902,044 A * 10/1908 Augenbraun ..... 70/451
924,801 A * 6/1909 Lockwood ..... 70/452
1,005,099 A * 10/1911 Bishop ..... 70/452
1,112,485 A * 10/1914 Snyder ..... 70/452

(Continued)

FOREIGN PATENT DOCUMENTS

DE 298 07 898 U1 9/1998

(Continued)

*Primary Examiner*—Daniel P. Stodola
*Assistant Examiner*—Carlos Lugo
(74) *Attorney, Agent, or Firm*—Cohen, Pontani, Lieberman & Pavane

(57) ABSTRACT

The invention relates to fittings (1, 21) for the fixing and/or locking arrangement of a glass element (45) on at least one adjacent glass element, whereby the fittings (1, 21) are composed of fitting halves (2, 3, 22, 23, 26, 27) each consisting of a substructure (42) fixed to the glass element (45) and of a covering (25) that crowns the substructure (42). The aim of the invention is to create a fitting (1, 21), which forms a compact and visually appealing unit having a smallest possible overall height, whereby retaining the existing diversity of use and the various functions. To this end, the covering (25) comprises a front surface (7, 30), which is fixed between lateral faces (5, 6, 28, 29) and which curves in a convex manner from one edge (8, 31) to the opposite edge (9, 32).

38 Claims, 15 Drawing Sheets

U.S. PATENT DOCUMENTS

| | | | | | |
|---|---|---|---|---|---|
| 1,679,026 | A | * | 7/1928 | Fekete | 70/210 |
| 2,702,720 | A | * | 2/1955 | Young | 292/357 |
| 4,640,112 | A | * | 2/1987 | Kambic | 70/452 |
| 4,721,205 | A | * | 1/1988 | Burt et al. | 206/317 |
| 4,728,133 | A | * | 3/1988 | Valley | 292/336.3 |
| 4,873,853 | A | * | 10/1989 | Foshee | 70/452 |
| 4,895,399 | A | * | 1/1990 | Horgan, Jr. | 292/92 |
| 5,566,996 | A | * | 10/1996 | Massey et al. | 292/357 |
| 5,577,779 | A | * | 11/1996 | Dangel | 292/80 |
| 5,960,517 | A | * | 10/1999 | Sprekeler | 292/336.3 |
| 5,983,683 | A | * | 11/1999 | Shen | 70/224 |
| 6,130,382 | A | * | 10/2000 | Hung | 174/35 R |
| 6,463,628 | B1 | * | 10/2002 | Yeh | 16/412 |
| 1,038,754 | A1 | * | 7/2005 | Ohtsubo | 70/454 |

FOREIGN PATENT DOCUMENTS

| | | |
|---|---|---|
| DE | 200 05 982 U1 | 7/2000 |
| DE | 299 16 376 U1 | 12/2000 |
| EP | 0 721 759 A1 | 12/1995 |
| FR | 492 857 | 10/1970 |
| FR | 2.127.284 | 10/1972 |

* cited by examiner

FITTING

PRIORITY CLAIM

This is a U.S. national stage of application No. PCT/EP01/10898, filed on Sep. 20, 2001. Priority is claimed on that application and on the following applications: Country: Germany, Application No.: 100 47 559.0, Filed: Sep. 22, 2000; Country: Germany, Application No.: 100 47 557.4, Filed: Sep. 22, 2000; Country: Germany, Application No.: 100 47 558.2, Filed: Sep. 22, 2000; Country: Germany, Application No.: 201 05 539.2, Filed: Mar. 28, 2001.

BACKGROUND OF THE INVENTION

1. Field of the Invention

The invention concerns a fitting for the rigid and/or flexible mounting of a glass element on at least one adjacent glass element, the fitting including halves which each have a substructure for mounting on the glass element and a cover that fits over the substructure.

2. Description of the Related Art

The catalogue "DORMA Glass Fitting Technology, Edition September 1998" contains fittings of this type both with and without integrated locks or built-in handles. Each fitting consists of two fitting halves. Each fitting half is modularly constructed and consists essentially of a substructure, which is formed from a base and a functional insert, in which, e.g., the actual lock and/or a latch mechanism is integrated, and a cover that fits over the substructure. This provides various possibilities for joining both indoor and outdoor all-glass elements.

The dihedral angle of glass elements that are flexibly mounted on each other is limited by, among other factors, the shape of the fittings, their covers, and their handles. The angular shape of the previously known covers is a disadvantage in this respect, because their edges meet too soon and restrict the dihedral angle. Due to the formation of the edges, the covers require expensive manufacture and are less than optimum from the standpoint of the economical use of material. Furthermore, the cover can result in personal injury, especially during cleaning work.

Attachment of the covers by clips or catches is disadvantageous. Even during the initial installation, the catches can be damaged or broken off. Especially after repeated disassembly or assembly, tight seating of the cover is no longer guaranteed. In the event of excessive stress on the element, especially in the case of movable door elements, shaking and vibration can adversely affect the catch.

SUMMARY OF THE INVENTION

The goal of the invention is to develop a fitting which forms a compact and visually pleasing unit with the smallest possible overall height and lateral extent, while retaining the previous multiplicity of use and variety of functions. In particular, it must be possible to attach the cover of the fittings securely on the substructure beneath it.

This goal is achieved by the cover having a pair of opposed lateral faces, a pair of opposed edges, and a front face that extends between the lateral faces and runs with a convex curvature between the opposed edges.

The fittings of the invention have the advantage that a small overall height and compact unit can be realized as a result of the elongated cover's convex outer form, which extends in one arrow direction. The angular outer form is avoided. Accordingly, the substructure located beneath the cover is rounded, at least at the corners, so that a flat support of the cover is formed. The curvature thus allows optimum utilization of the structural space and optimization of the manufacturing expense and the material that is used.

Although the material requirement for the cover of the invention is extremely small, the stability properties and functional properties are guaranteed. In particular, the at least partially flat support of the cover on the substructure damps vibrations caused by use and thus prevents unwanted loosening of the cover.

The resulting outer contours have a visually pleasing design due to the flowing and seamless transitions. All edges and borders are provided with radii. The result is a universal, model-independent, but general, outer design line. All material thicknesses are reduced to a minimum. The flowing curve of the outer contours, especially of the front surface, significantly reduces the use of material and reduces, for example, manufacturing problems related to casting practice. Metallic materials, plastics, or so-called hybrid materials are conceivable. The color design is practically unlimited. The specified properties also contribute significantly to a reduction in production costs.

The covered arrangement of the substructure prevents inadvertent manipulations and function-inhibiting contamination and creates an advantageous visual appearance, including the aspect of transparency of the glass elements. Furthermore, there are no projecting parts, so that the cleaning of the glass surfaces is also facilitated.

The fitting can be used both for rigid attachment of a glass element, e.g., to a stationary glass element, and for flexible attachment to adjacent glass elements. The interacting fittings are designed to complement each other in such a way that they visually constitute a unit.

In the case of supporting a movable glass element on the upper side and the lower side, the fitting attached to the stationary glass element is preferably angularly designed for reasons of stability and in this way can simultaneously rigidly join a transom window and a side part with each other. The fitting attached to the movable glass element is rectangularly designed, so that the overall view is of a rectangular unit. The glass elements flexibly joined to each other by the fittings can be opened to a dihedral angle of almost 180° due to the advantageous shape of the cover.

Furthermore, a lock can be integrated in the fitting. The lock fitting is used for doors that are supported on a stationary side part or transom window made of glass and, depending on the design, can be installed on the upper side or lower side as a so-called corner lock fitting or as a normal centrally arranged lock fitting. The outer form of the fitting, i.e., the curvature of the front surface, continues in the opposing fitting. The functional insert contains at least the key-operated lock and possibly the devices for integration of a door latch. In the case of a nonglass frame, coordination with the frame structure is necessary only with respect to satisfactory function between the moving elements (latch, lock) in the lock fitting of the invention and the corresponding openings of the locking plate on the frame side. The interacting fittings are designed to complement each other in such a way that they visually constitute a unit.

In a preferred embodiment, a handle is integrated in the lock fitting, such that the lock fitting and the handle form a general outer design line that matches in an esthetic and visual sense.

The handle has the advantage that a reduction of the spatial extent is realized by the grip, which is curved in the direction of a hinged element, e.g., a door. A projecting free end of the grip is avoided. The curvature thus allows optimum utilization of the structural space and optimization of the manufacturing expense and the material that is used.

The user is given a definite sense of grip. Due to an inwardly bent or curved design of the grip, a haptically advantageous tactile surface is created, which gives the user a definite sense of grip and, especially when the user has an incomplete grasp of the grip, prevents the hand from slipping. Furthermore, the danger of catching articles of clothing or other objects on the grip is minimized, since the distance between the free end and the swiveling element is extremely small.

The handle consists of a grip, to which a connecting element is attached at one end to form a single piece. The connecting element serves the purpose of nonpositive connection with, for example, a door. The grip and the connecting element have a round cross section. The diameter of the connecting element preferably increases in the direction of the swiveling element. On the one hand, this minimizes the use of material, and, on the other hand, it ensures stable mounting of a latch pin, which mechanically connects the handle with a locking mechanism and an opposing handle.

The free end of the grip is bounded by an inclined, preferably flat, front surface, whose region facing the swiveling element is preferably farther from the connecting element than its region facing away from the swiveling element. The transitions between the front surface and the grip have radii or bevels.

The handle is advantageously manufactured in a casting process as a single piece and then finished. The flowing curve of the outer contours reduces, for example, manufacturing problems related to casting practice.

The handle and its individual parts can be manufactured from various materials, such as brass, iron, stainless steel, aluminum, or bronze, or from other nonmetallic materials, such as plastic.

Handles in accordance with the invention may be used as door grips, window grips, or other types of grips, which are used purely as handles or may have functions relevant to locking. Uses that are relevant to locking, e.g., door or window grips, are realized principally by a handle that is operated by turning, such that the handle is coupled with the locking mechanism of the door or window.

A fitting of the invention wherein the cover is spring-mounted on the substructure with frictional resistance has the advantage that the attachment of the cover involves no catches or clips, which are susceptible to wear and may fail, e.g., as a result of material fatigue. The realization of a partially spring-loaded mounting also makes it possible to compensate for use-related shaking or vibrations; greater tolerance compensation of the components that are used also presents no problems.

In its inside chamber for holding the substructure of the fitting, the cover has openings on one side, which interact at least by frictional resistance with locking elements preassembled in the substructure, so that the two complementarily engage each other. For the final mounting of the cover, grooves are engaged with pins that are spring-mounted in the substructure. The locking elements may be designed, e.g., as slotted pins, which are driven into bores in the substructure. In another embodiment, the locking elements are designed as so-called grub screws, which can be screwed into tapped holes.

To install the locking elements, either a striking tool or a screwdriver is needed, depending on the design. The locking elements are either formed on the substructure as a single piece during manufacture or are preinstalled in the substructure directly on site before the fitting is mounted. This also ensures that the relatively small components are not lost. The locking elements form a blockade in the openings against horizontal loads, so that it is not possible for the cover to swing out. In the event that disassembly becomes necessary, the cover is pushed as far as possible in the spring-relieving vertical direction, so that the grooves and pins can then be disengaged under a slight tensile load by swinging away the cover. On the opposite side, the connection between the openings and the locking elements can then be broken by simple vertical movement of the cover. No tools are needed either for assembly or disassembly of the cover. In this way, damage to the often sensitive surfaces of the covers and plate-shaped elements is prevented.

The externally invisible connection between the spring-supported pins and the grooves is preferably arranged on the side of the fitting facing the viewer, while the locking connections are arranged on the side of the fitting turned away from the viewer.

DETAILED DESCRIPTION OF THE PRESENTLY PREFERRED EMBODIMENTS

Figures 1, 2:
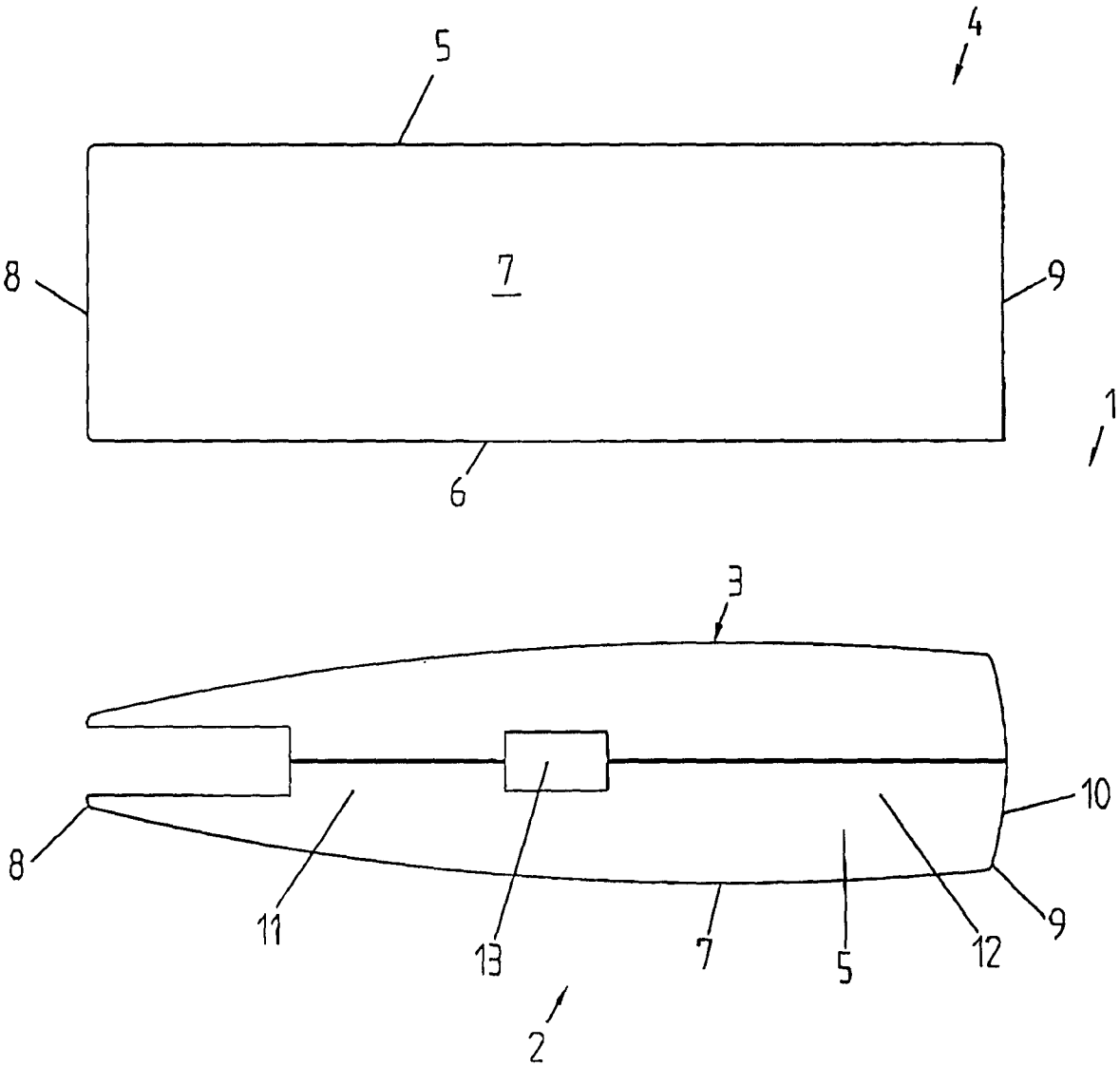
FIG. 1 shows a top view of a fitting.
FIG. 2 shows a front view of the fitting in FIG. 1.

Components that are the same or have the same function are labeled with the same reference numbers in the following description; in particular, mirror-symmetrical components are identically labeled.

Each of the fittings 1 shown schematically in FIGS. 1 to 8 consists of mirror-symmetrical fitting halves 2 and 3, such that each fitting half 2 and 3 has a substructure 42 and a cover 4 mounted on it. The substructure 42 may be composed of a base 43 and a functional insert 44. See also FIGS. 23–25.

Fittings 1 of this type are used, e.g., for the rigid or flexible connection of glass elements in all-glass units. The glass elements have bores or openings to allow mounting of the bases 43 on both sides, preferably by clamping with screws, possibly with the intermediate insertion of a glass protector. Functional inserts 44 are then mounted on these bases 43. The functional inserts 44 may allow, for example, flexible support or rigid mounting of an adjacent glass element. This modular construction of the fitting system allows interchangeable use of bases 43, functional inserts 44, and covers 4. The glass elements may be designed, e.g., with specific colors or profiles.

The more detailed explanation and representation of the embodiments are limited below to the immediate region of the fittings 1. The substructure 42 and its base 43 and functional insert 44 are not shown, since each of them is located completely and invisibly below the respective cover 4. All of the functional elements are thus also advantageously covered, so that they are not visible.

FIGS. 1 and 2 show a first embodiment of a fitting 1 in accordance with the invention. Its fitting halves 2 and 3 and their covers 4 are shown in the installed state in a view towards the edge (not shown) of a glass element. Due to the mirror symmetry of the fitting halves 2 and 3, the following description applies to both fitting halves 2 and 3. Each cover 4 has two horizontally oriented lateral faces 5 and 6, between which a front face 7 extends from one vertical edge 8 to an opposite vertical edge 9. The cover 4 has a rectangular, elongated outer shape. The front face 7 has an outwardly directed convex curvature, which increases starting from the edge 9 shown on the right side of the drawing to the left edge 8. The right edge 9 has an angularly projecting lateral face 10, which spans a vertical edge of the glass element. This lateral face 10 is also shaped outwardly convex. At the left edge 8, the front face 7 tapers to an apex due to the greater curvature, so that a direct glass support is formed there. The lateral face 5 is partially formed on the glass edge with extensions 11 and 12, which cover the glass edge. Between the extensions 11 and 12, there is a recess 13, through which the elements connecting the functional inserts, e.g., in the form of a bearing pin, are connected.

Figure 3:
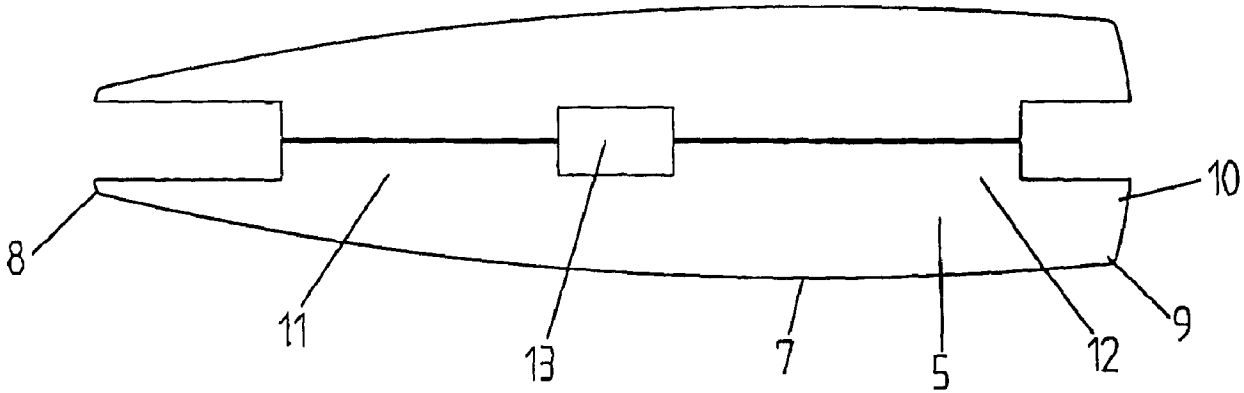
FIG. 3 shows a top view of another embodiment of a fitting.
Figure 4:
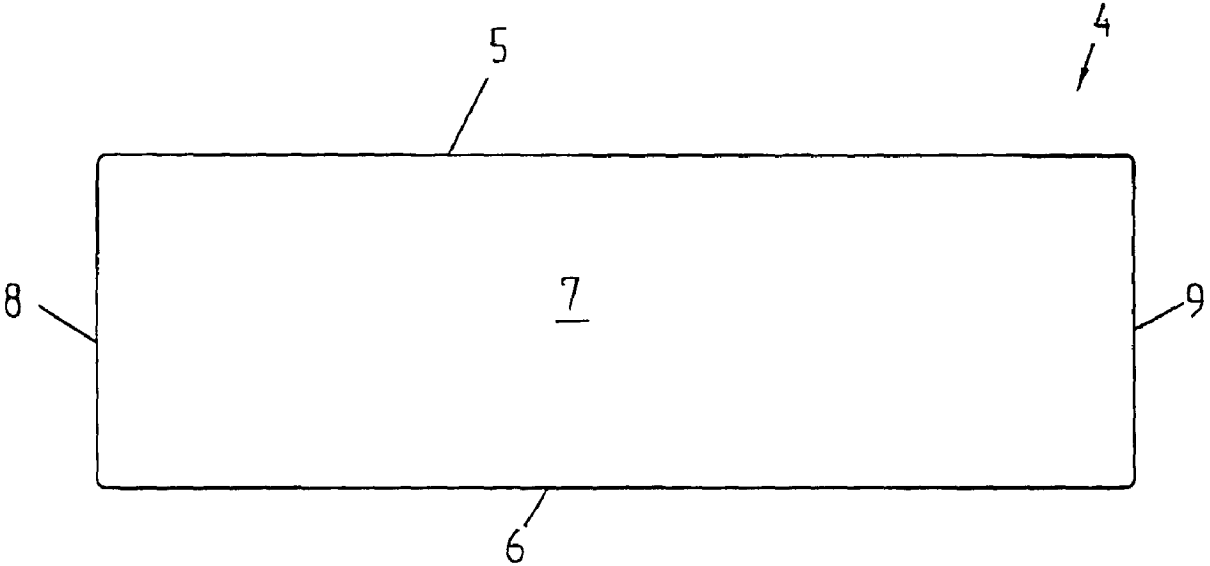
FIG. 4 shows a front view of the fitting in FIG. 3.
Figure 5:
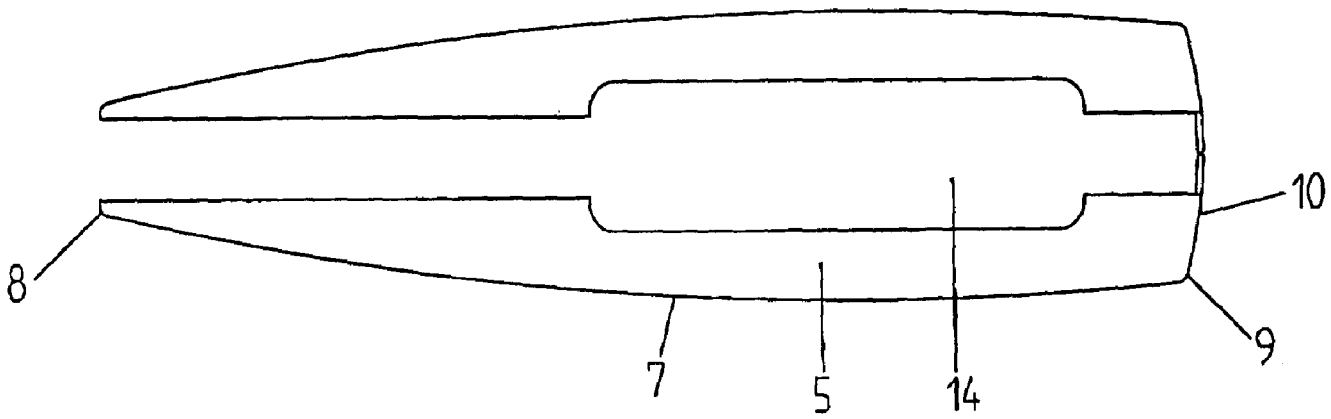
FIG. 5 shows a top view of another embodiment of a fitting.
Figure 6:
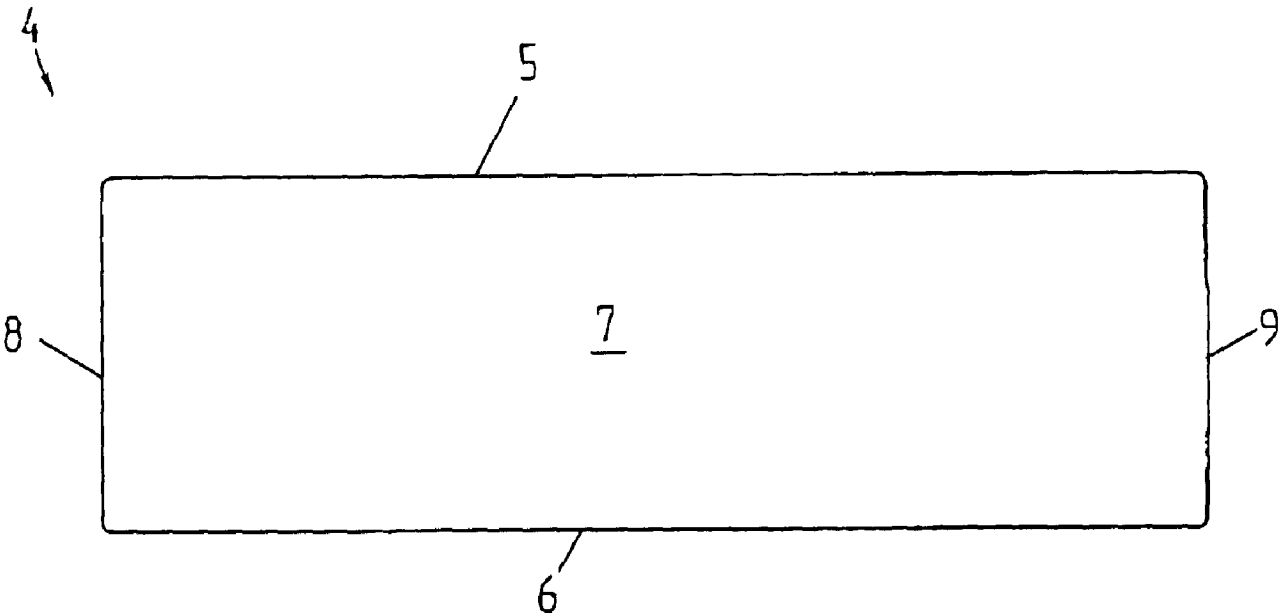
FIG. 6 shows a front view of the fitting in FIG. 5.

FIGS. 3 and 4 show a modified embodiment of FIGS. 1 and 2, in which a shortened lateral face 10 is formed on the vertical glass edge. FIGS. 5 and 6 show another embodiment, in which no extensions are formed on the lateral face 5. The lateral face 5 has a recess 14, so that functional inserts can interact.

Figure 7:
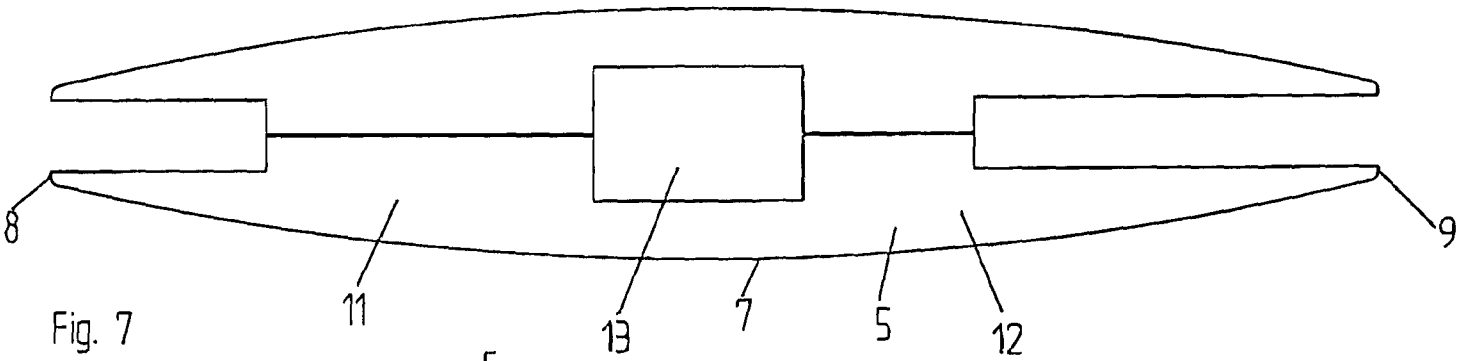
FIG. 7 shows a top view of another embodiment of a fitting.
Figure 8:
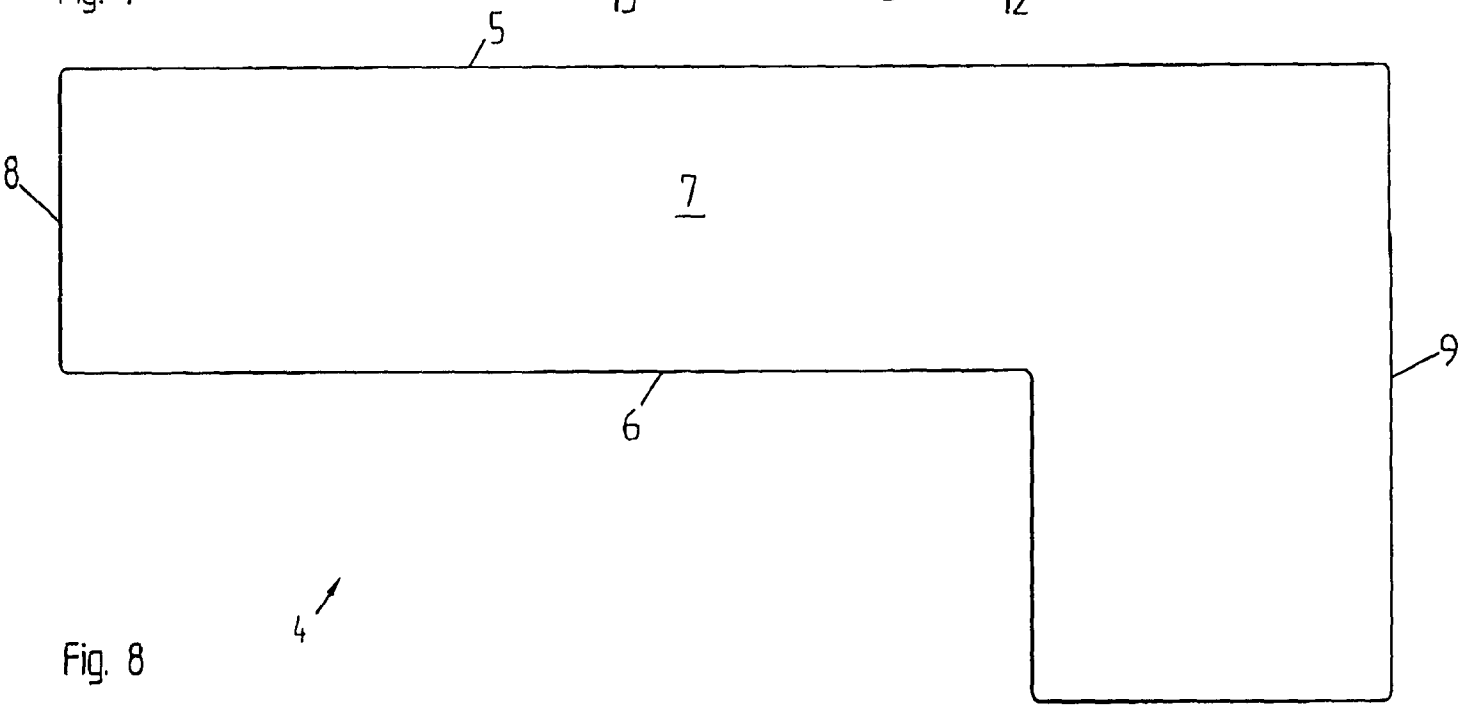
FIG. 8 shows a front view of the fitting in FIG. 7.

FIGS. 7 and 8 show another embodiment, which is suitable for a fitting 1, which rigidly connects a transom window and a side part and on which another glass element is flexibly supported. The components essentially correspond to those of the embodiments described above. Each fitting half 2 and 3 is additionally designed with an angled projection 15 for the stationary connection of the side part. The front face 7 is uniformly curved from one edge 8 to the opposite edge 9 and tapers to an apex at both ends directly on the surface of the glass. The lateral face 5 is likewise provided with extensions 11 and 12 and a recess 13.

Each of the lock fittings 21 shown schematically in FIGS. 9 to 16 consists of fitting halves 22 and 23, each of which has a substructure 42 and a cover 25 mounted on it. The substructure 42 consists of a base 43 and a functional insert 44. See also FIGS. 23–25.

Lock fittings 21 of this type are used, e.g., for glass elements used as doors. The glass elements are supported on a stationary glass side part or transom window. The more detailed explanation of the embodiments is always limited to one fitting half, due to the functional similarity.

Figure 10:
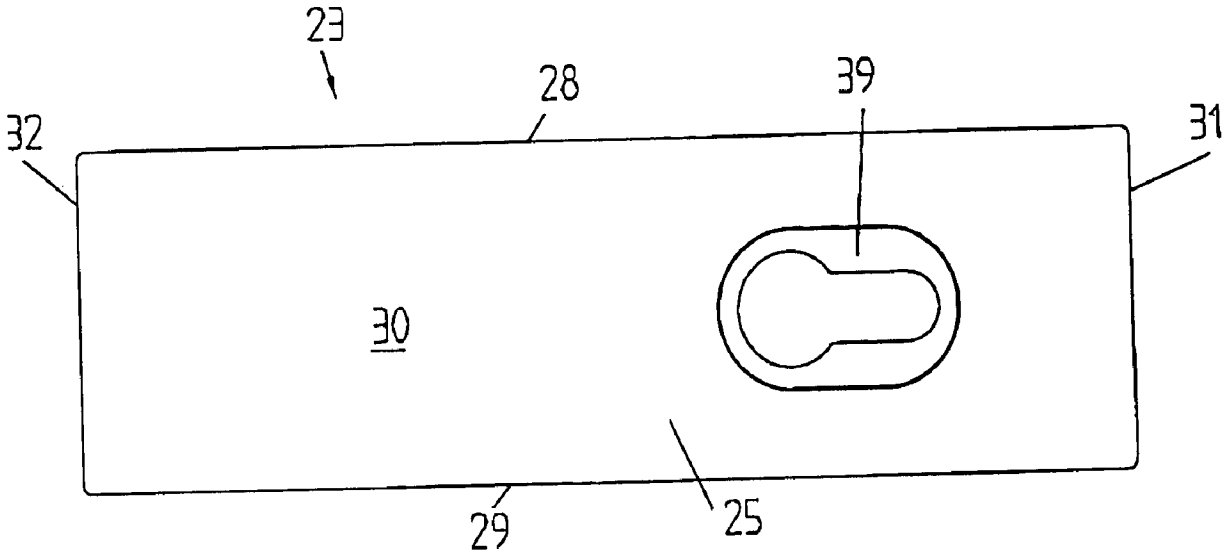
FIG. 10 shows a front view of the lock fitting in FIG. 9.
Figure 9:
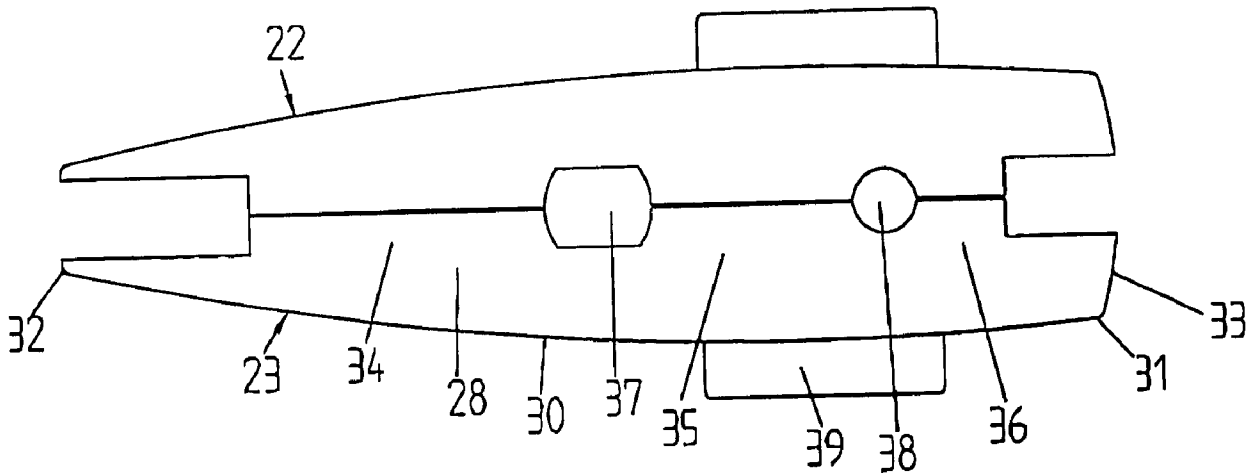
FIG. 9 shows a view of a lock fitting.

FIGS. 9 and 10 show a first design of the lock fitting 21 as a so-called corner fitting, such that the lock fitting 21 is mounted at the upper and/or lower corner on the swiveling side of a glass element, which is not shown in the drawings. In this case, the glass element is designed to have a push grip in the middle of the door and is locked relative to the surrounding field by locks located in the corner fittings. The covers 25 of this lock fitting 21 are shown in the installed state in a view towards the edge (not shown) of a glass element. The covers are positioned opposite each other with mirror symmetry, and each has a rectangular, horizontally elongated outer shape. Each cover 25 has two horizontally oriented lateral faces 28 and 29, between which a front face 30 extends from one edge 31 to the other edge 32. The front face 30 has an outwardly directed convex curvature, which increases starting from the edge 31 shown on the right side of the drawing to the left edge 32. The right edge 31 has an angularly projecting lateral face 33, which spans the vertical edge of the glass element. At the left edge 32, the front face 30 tapers to an apex due to the greater curvature, so that a direct glass support is formed there. The lateral face 28 is partially formed on the glass edge with extensions 34, 35, 36, so that the glass edge is covered by them. Between the extensions 34, 35, 36, there are recesses 37, 38, through which the elements located in the functional inserts, e.g., in the form of a locking bolt, can be passed. The front face 30 of the cover 25 has a projection 39, by which the lock (not shown) is covered.

Figure 12:
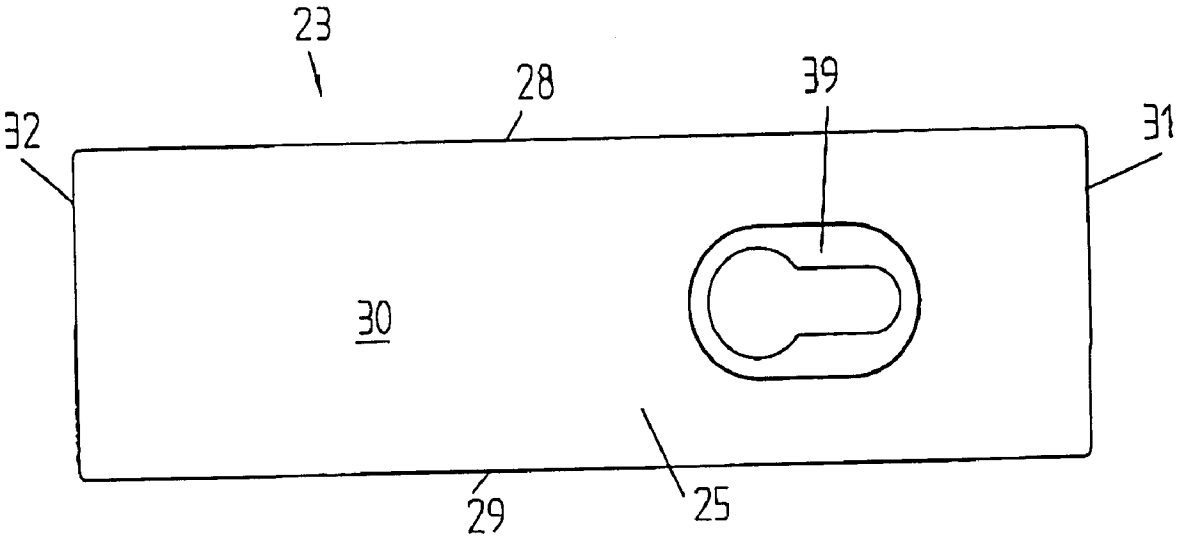
FIG. 12 shows a front view of the lock fitting in FIG. 11.
Figure 11:
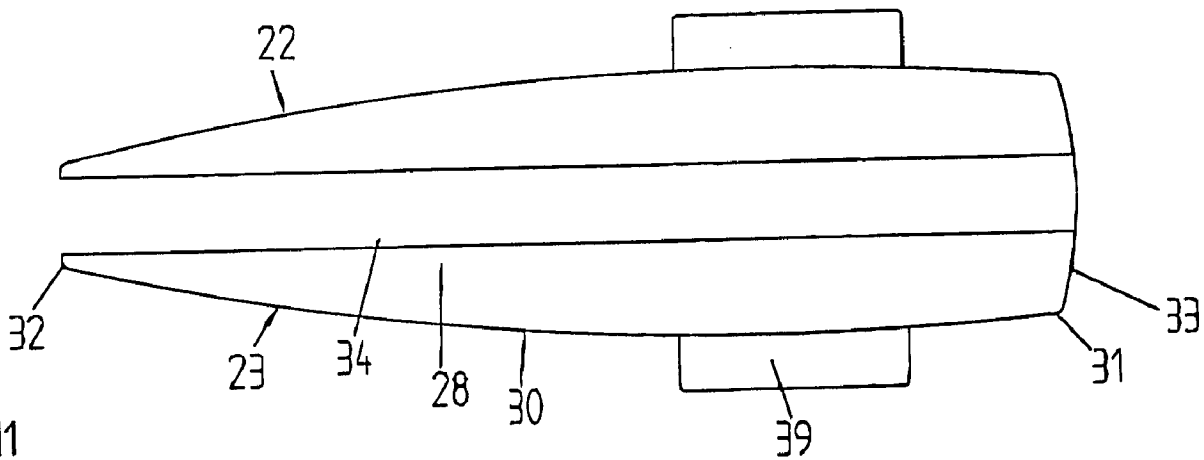
FIG. 11 shows a view of another embodiment of a lock fitting.

FIGS. 11 and 12 show a modified embodiment of FIGS. 9 and 10, so that the lock fitting 21 can also be used in the middle of a door. Therefore, no extensions are formed on the lateral faces 28 and 29. The locking bolt is locked horizontally here.

Figure 13:
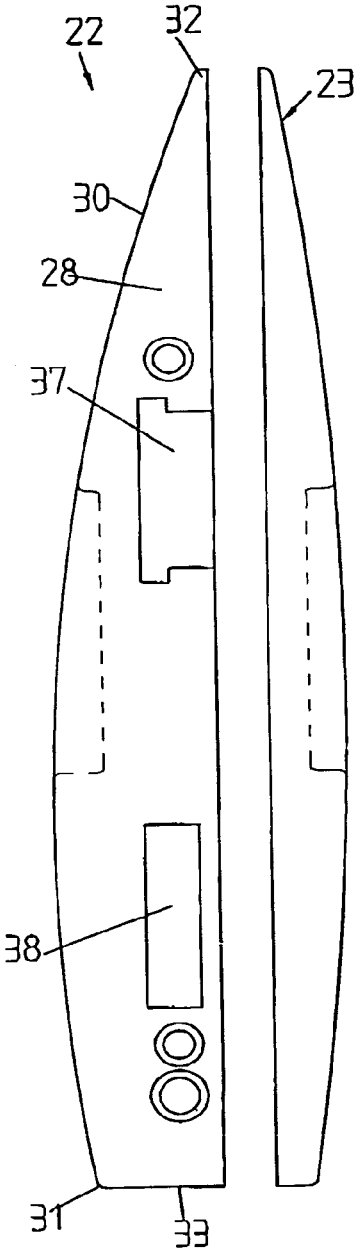
FIG. 13 shows a view of another embodiment of a lock fitting.
Figure 14:
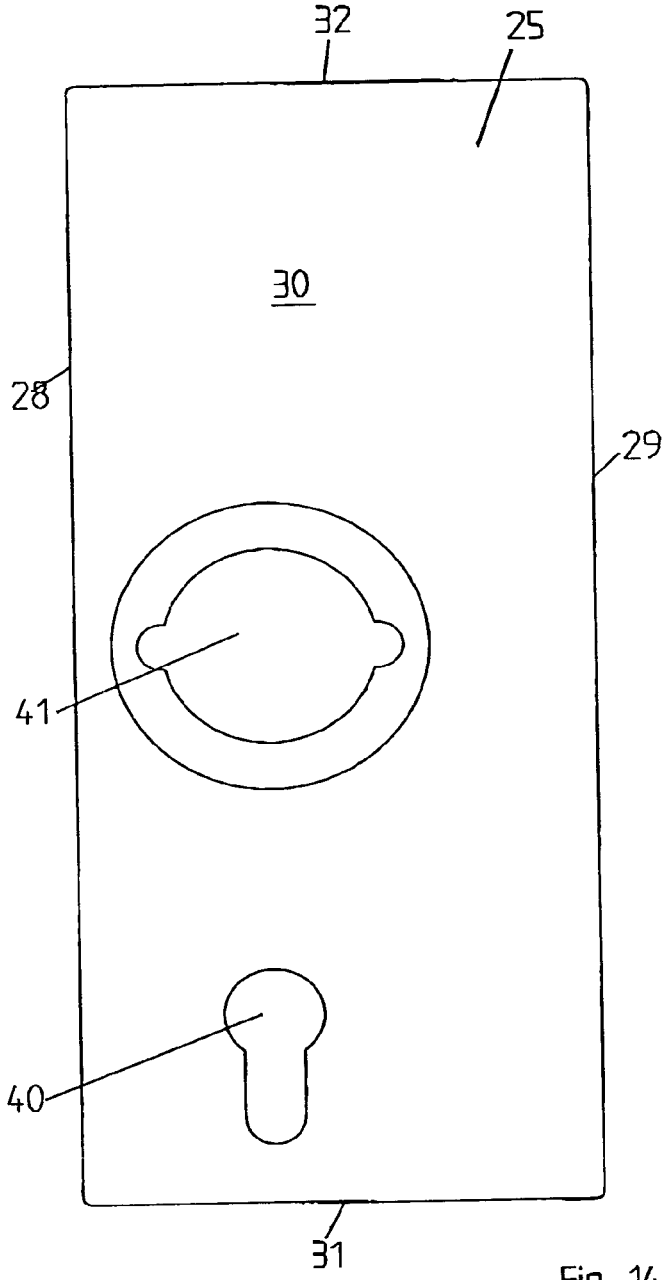
FIG. 14 shows a front view of the lock fitting in FIG. 13.

FIGS. 13 and 14 show a design of the lock fitting 21 of the invention as a center fitting, such that the lock fitting 21 is mounted preferably in the middle on the swiveling side of a glass element. In this case, the lock fitting 21 can have a door latch, which is not shown in the drawings, with a latch and a lock with a bolt, which work together with corresponding fittings of a locking plate (not shown). The covers 25 of this lock fitting 21 are shown in the installed state in a view towards the vertical edge (not shown) of a glass element. Each of the covers 25 has a rectangular, vertically elongated outer shape. Each cover 25 has two vertically oriented lateral faces 28 and 29, between which a front face 30 extends from one horizontal edge 31 to the opposite horizontal edge 32. The front face 30 has an outwardly directed convex curvature, which increases starting from the edge 31 at the bottom of the drawing to the upper edge 32. The lower edge 31 has an angularly projecting lateral face 33, which rests on the surface of the glass element. At the upper edge 32, the front face 30 tapers to an apex due to the greater curvature, so that a direct glass support is formed there. The lateral face 29 contains recesses 37 and 38, through which the elements located in the functional inserts, e.g., in the form of a latch and a locking bolt, can be passed. In the front face 30, there are openings 40 and 41, through which the lock can be operated by a door latch. The opposing half 23 of the fitting has the same shape but is considerably flatter in design.

Figure 15:
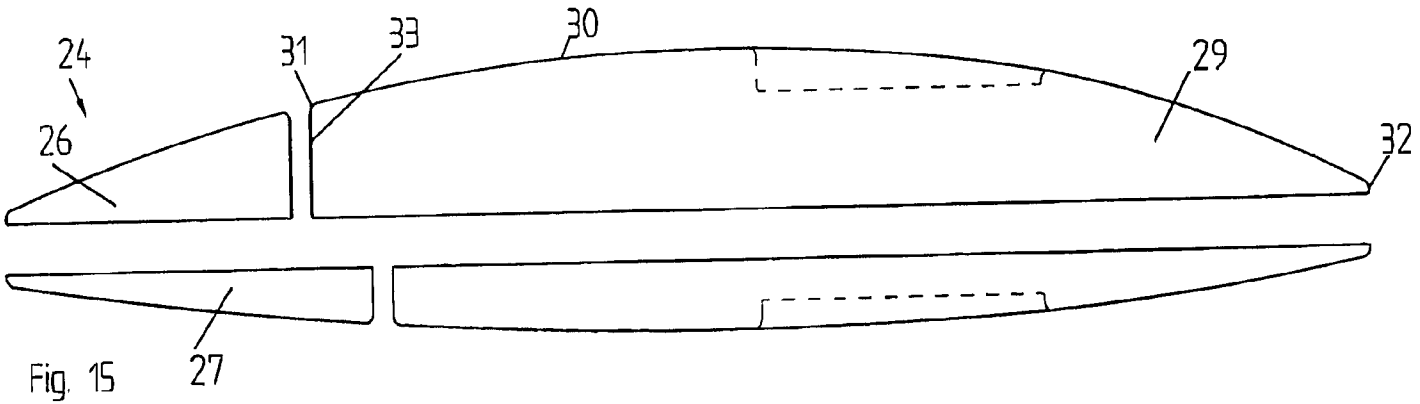
FIG. 15 shows a view of another embodiment of a lock fitting.
Figure 16:
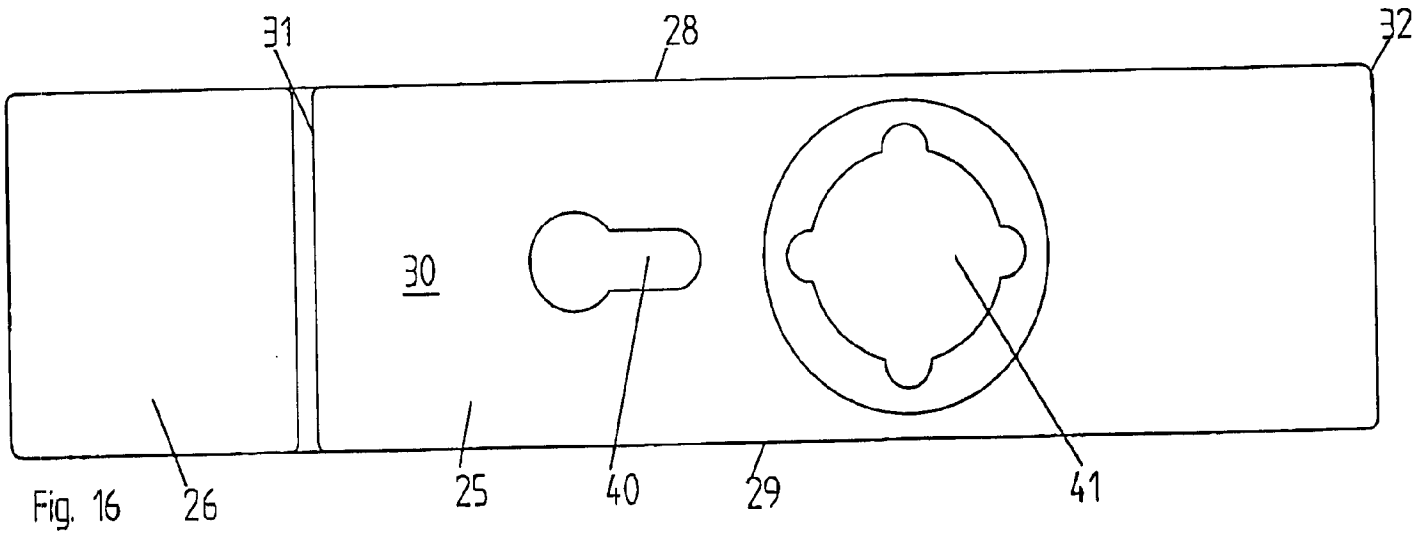
FIG. 16 shows a front view of the lock fitting in FIG. 15.

FIGS. 15 and 16 show a design of the lock fitting 21 of the invention as a center fitting with horizontal orientation, such that the lock fitting 21 is mounted preferably in the middle on the swiveling side of a glass element. In this case, the lock fitting 21 has a door latch with a latch and a lock with a bolt, which work together with corresponding holding fixtures of an opposing fitting installed in a side part. The fitting halves 26 and 27 of the opposing fitting 24 are also shown and produce an ergonomic unit in continuation of the curved shape of the fitting halves 22 and 23 of the lock fitting 21. The covers 25 lie opposite each other, and each has a rectangular, horizontally elongated shape. Each cover 25 has two horizontally oriented lateral faces 28 and 29, between which a front face 30 extends from one vertical edge 31 to the other edge 32. The front face 30 has an outwardly directed convex curvature, which increases starting from the edge 31 shown on the left side of the drawing to the right edge 32. The left edge 31 has an angularly projecting lateral face 33. At the right edge 32, the front face 30 tapers to an apex due to the greater curvature, so that a direct glass support is formed there. In the lateral edges 33 on the frame side, there are recesses 37 and 38, through which the elements located in the functional inserts, e.g., in the form of a latch and a locking bolt, can be passed horizontally. The opposing fitting 24 installed in the side part follows in its shape the lateral face 33 of the lock fitting 21 and tapers to the surface of the side part. In this way, the whole fitting forms a unit and has a uniform curvature of the entire front face 30.

A handle 58, which can be inserted in the functional insert of a lock fitting 21, is shown in FIGS. 17 to 22.

The handle 58 consists essentially of a grip 59 and a connecting element 60, which is installed as a single piece at one end and produces the nonpositive locking connection to a swiveling element (not shown), such as a door or its fitting. Both the grip 59 and the connecting element 60 have a round cross section. The handles 58 are made of high-grade steel, bronze, brass, or some other metal.

Figure 17:
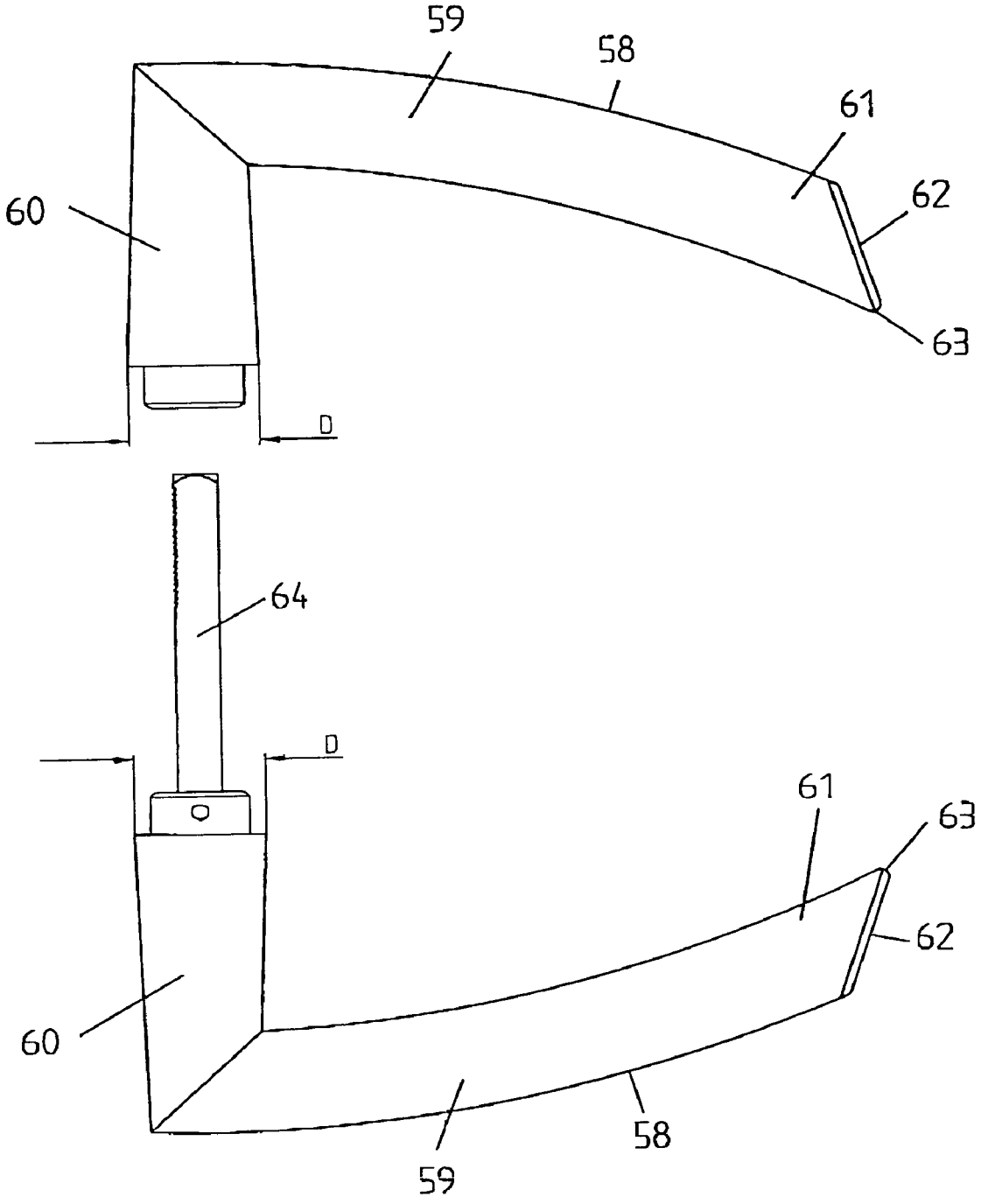
FIG. 17 shows a top view of a set of handles, which can be mounted on both sides of a swiveling element (not shown).
Figure 18:
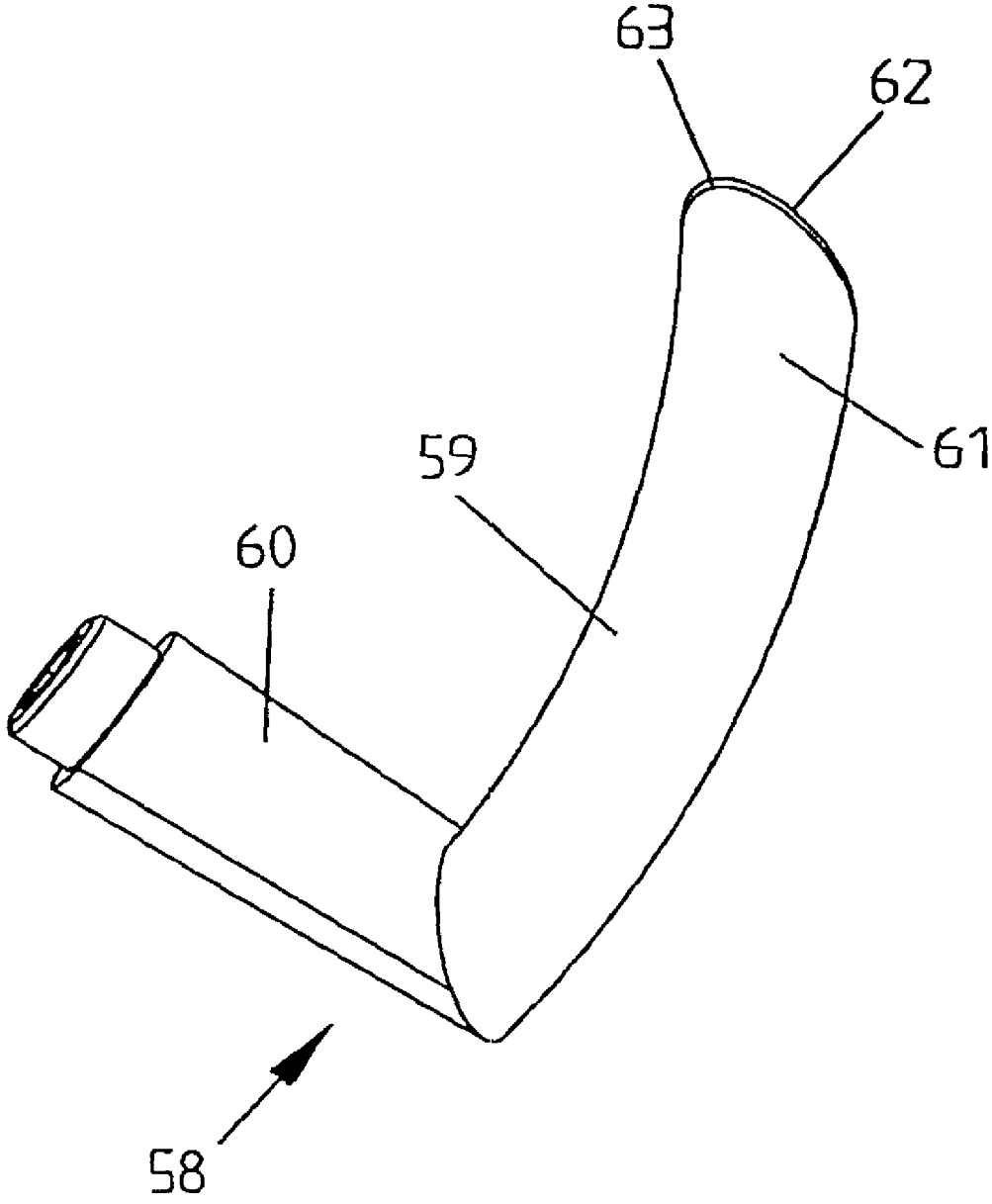
FIG. 18 shows a perspective view of a handle.

The embodiment shown in FIG. 17 is a set of two handles 58, which can be mounted on both sides of a swiveling element. The handles 58 are identical and can be mounted mirror-symmetrically to each other. Each grip 59 is curved convexly and sloped inward along its whole length. This results in a grip shape that corresponds to the natural shape of the hand, so that an advantageous tactile sense is assured. The grip 59 is designed without contours and has a uniformly round cross section.

The free end 61 of the grip 59 is bounded by an inclined, preferably flat end face 62, whose region near the swiveling element is farther from the connecting element 60 than its region farther from the swiveling element. The transitions between the end face 62 and the grip 59 have either bevels or radii 63.

The grip 59 makes the angular transition into the connecting element 60 as a single piece and at an angle of less than 90°. This creates the inwardly directed slope of the grip 59. The connecting element 60 is unprofiled and has a round cross section. The diameter D of the connecting element 60 preferably increases, starting at the grip 59. A latch pin 64 is installed in the connecting element 60 for connecting the handle 58 mechanically with a locking mechanism and/or an opposing handle 58.

Figure 19:
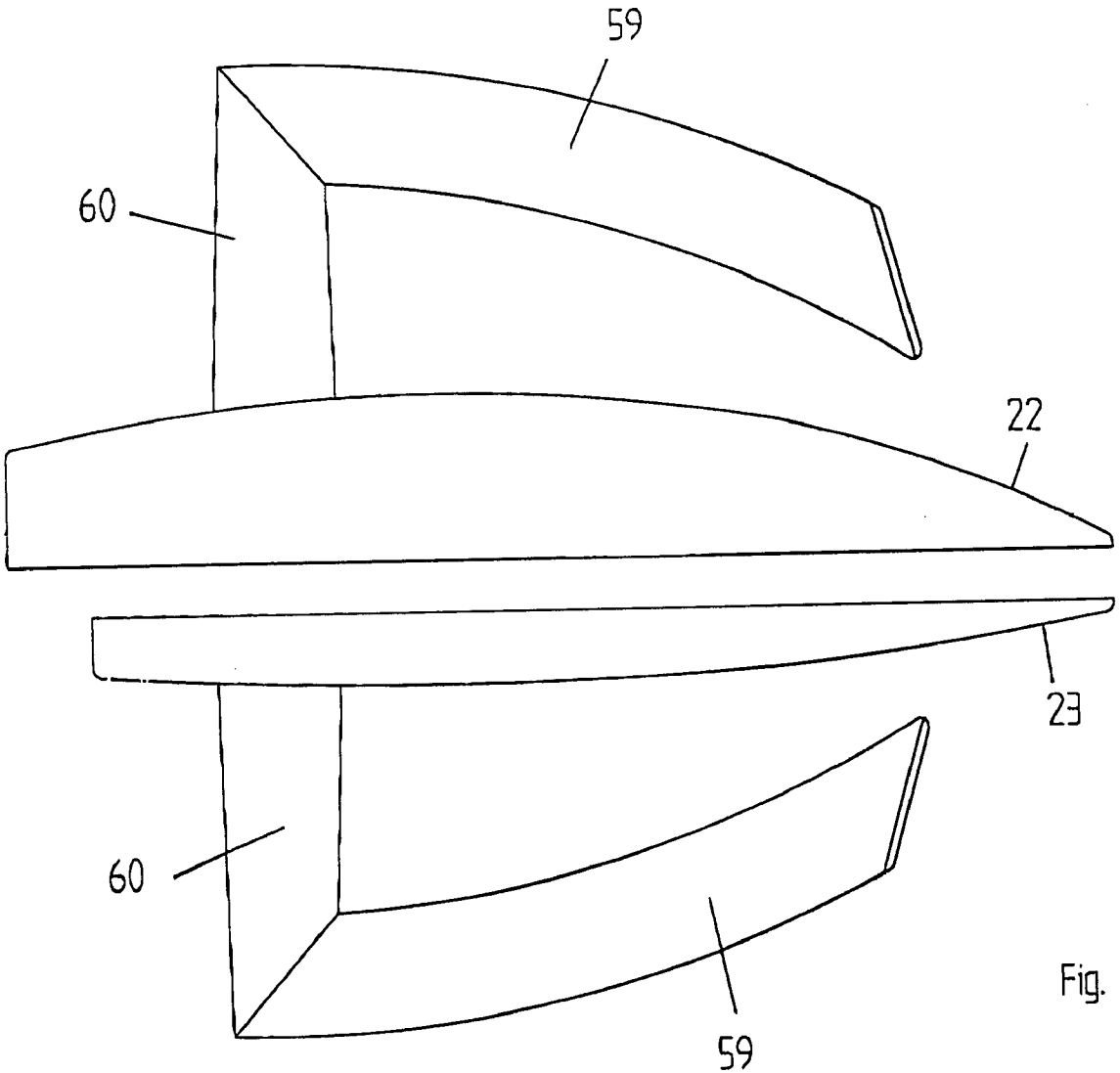
FIG. 19 shows a top view of a fitting with integrated handles.
Figure 20:
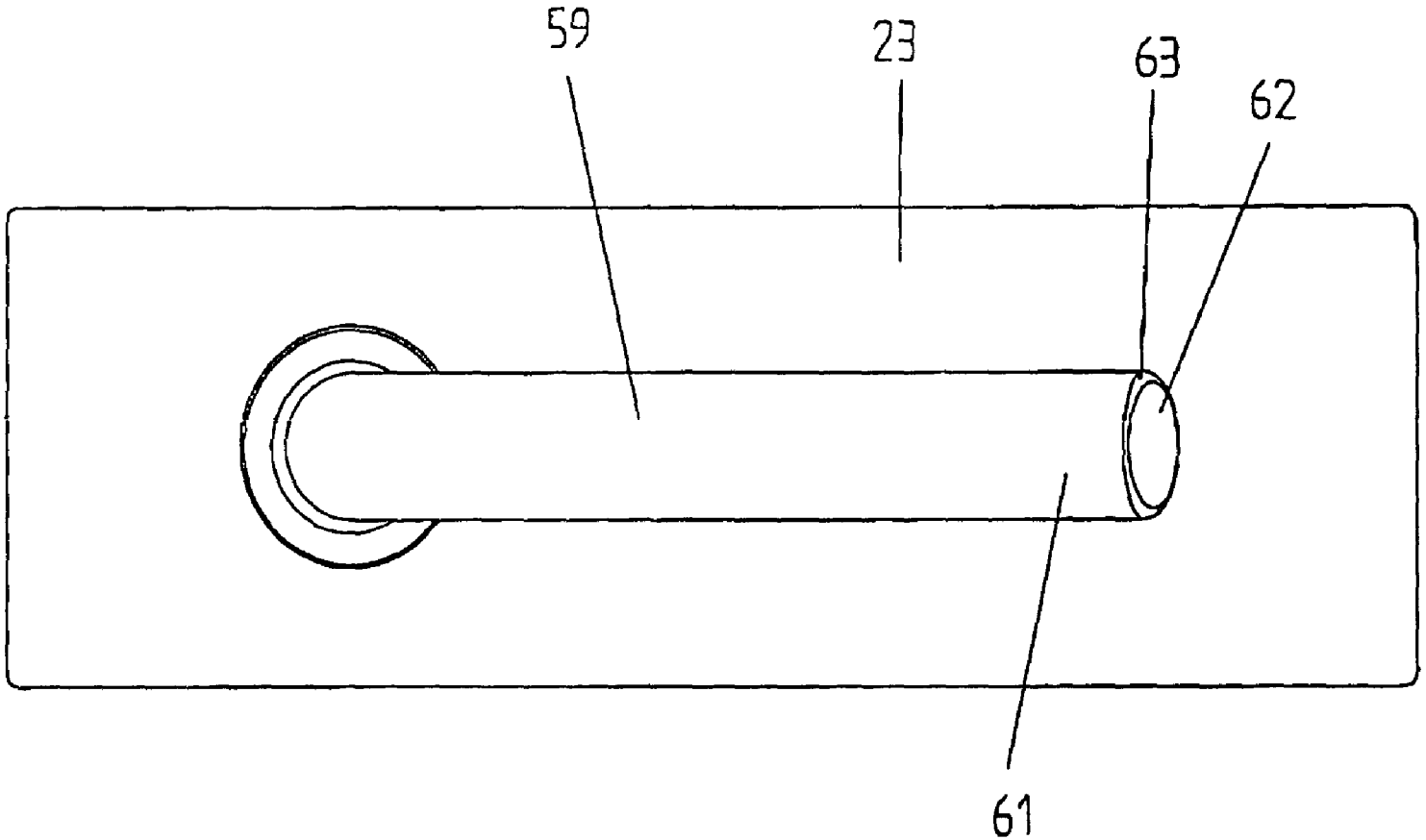
FIG. 20 shows a side view of the fitting in FIG. 19.

FIGS. 19 and 20 show a design of the fitting 21 as a center fitting with a horizontal orientation, such that the fitting 21 is preferably mounted in the middle on the swiveling side of a glass element. In this case, the handle 58 of the invention is integrated in the fitting and operates a latch by means of a locking mechanism installed inside the fitting 21. The latch works together with the corresponding holding fixtures of an opposing fitting (not shown) installed in a side part. The fitting halves of the opposing fitting produce an ergonomic unit in continuation of the curved shape of the fitting halves 22 and 23.

Figure 21:
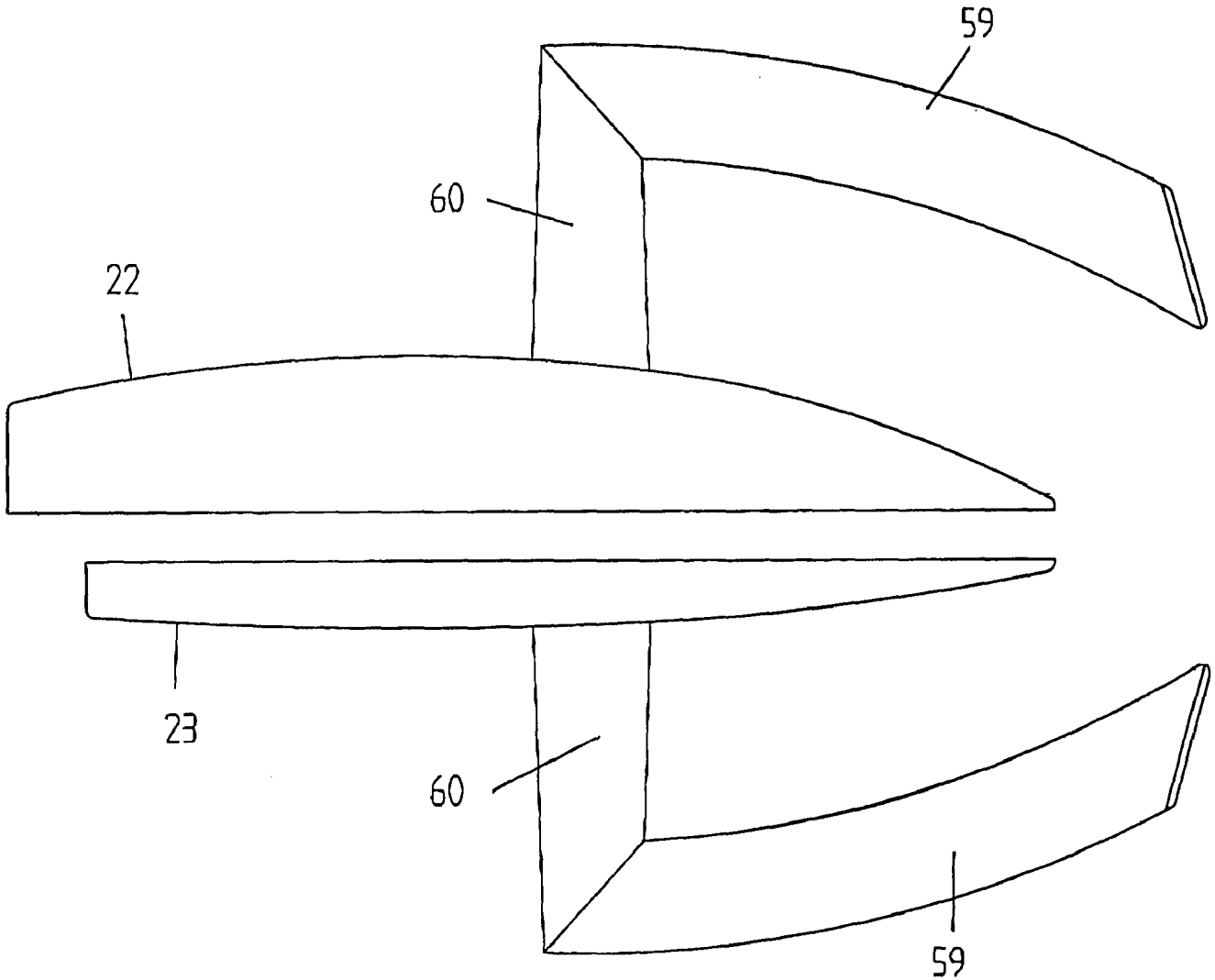
FIG. 21 shows a top view of another fitting with integrated handles.
Figure 22:
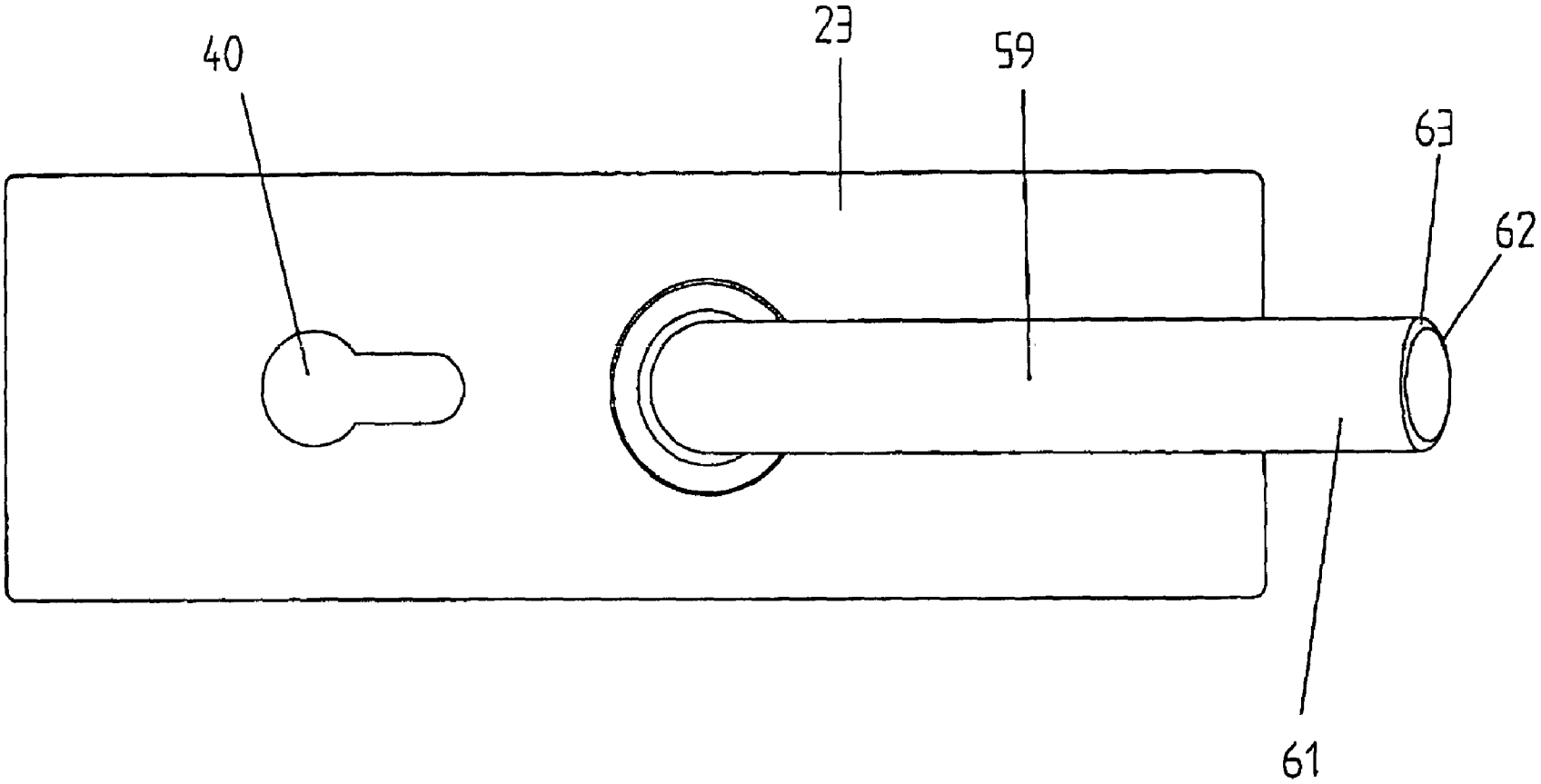
FIG. 22 shows a side view of the fitting in FIG. 21.

The fitting 21 shown in FIGS. 21 and 22 differs from the fitting 21 shown in FIGS. 19 and 20 only in that a lock can be additionally inserted into a corresponding opening 40. By means of the locking mechanism installed in the fitting 21, a key, which can be inserted in the lock, operates a latch, which engages a corresponding recess in the opposing fitting.

Figure 23:
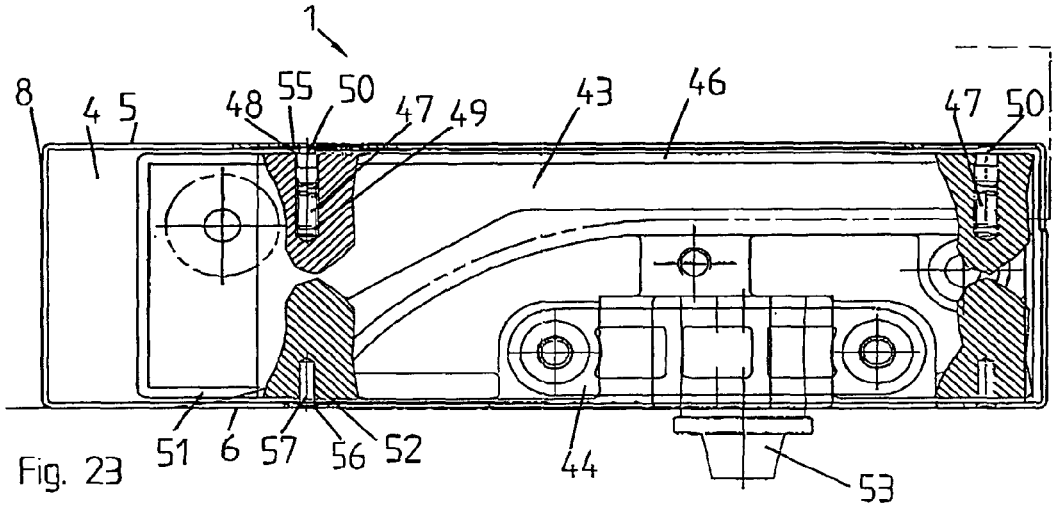
FIG. 23 shows a partial section of a mounted fitting in accordance with FIG. 5 and FIG. 6.
Figure 24:
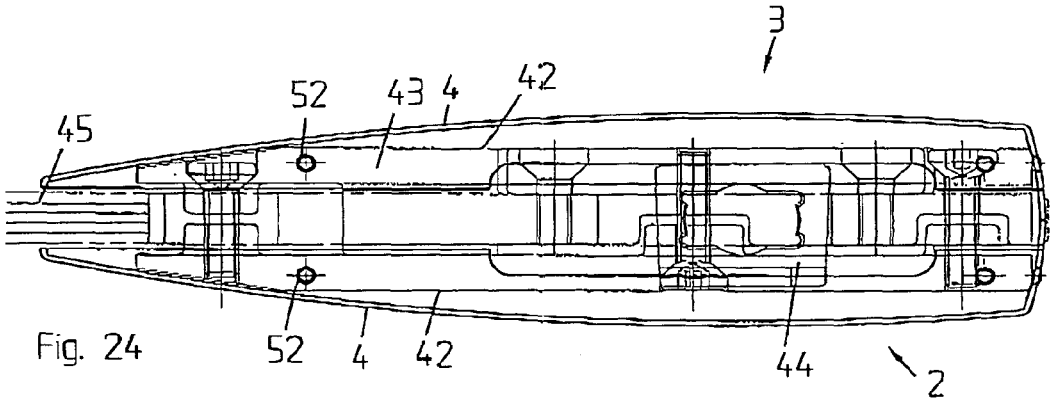
FIG. 24 shows a bottom view of the fitting in FIG. 23 mounted on a glass edge.
Figure 25:
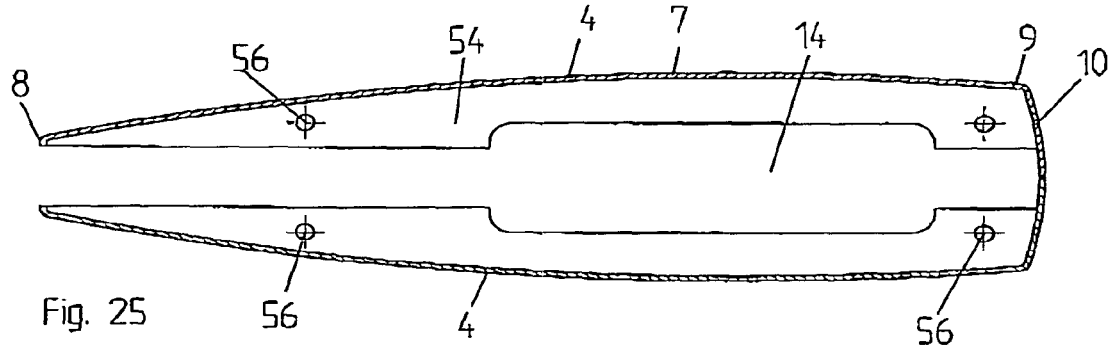
FIG. 25 shows a sectional view of an unmounted cover.

The basic design of a fitting 1 is described in greater detail on the basis of FIGS. 23 to 25. The design of a lock fitting 21 differs from it only by the integration of a lock and/or a handle. The fitting 1 consists of mirror-symmetrical fitting halves 2 and 3, each of which has a substructure 42 and a cover 4 mounted on it. The substructure consists of a base 43 and a functional insert 44.

As was described earlier, fittings 1 of this type are used for the rigid or flexible connection of all-glass elements 45 in all-glass units. The glass elements 45 have bores or openings to allow mounting of the bases 43 on both sides, preferably by clamping with screws, possibly with the intermediate insertion of a glass protector. Functional inserts 44 are then mounted on these bases 43. The functional inserts 44 may allow, for example, flexible support or rigid mounting of a glass element 45. This modular construction of the fitting system allows interchangeable use of bases 43, functional inserts 44, and covers 4. The glass elements may be designed, e.g., with specific colors or profiles.

The base 43 has a flat and basically rectangular design, and, on its upper longitudinal side 46 shown in FIG. 23, it has two vertically inwardly directed blind holes 47, which are spaced some distance apart and are narrowed towards the outside by a constriction 48. Each blind hole 47 contains a spring 49, which presses a stepped pin 50 against the constriction 48, so that the pin 50 is captively positioned in the blind hole 47. When the spring 49 is in its relaxed state, the pin 50 extends beyond the surface of the longitudinal side 46. In the lower longitudinal side 51 shown in FIG. 23, the base 43 has two vertically inwardly directed bores 52, which are spaced some distance apart. The bores 52 are axially aligned with the blind holes 47.

Each cover 4 has two horizontally oriented lateral faces 5 and 6, between which a front face 7 extends from one vertical edge 8 to an opposite vertical edge 9. The cover 4 has a rectangular outer shape. The front face 7 has an outwardly directed convex curvature, which increases starting from the edge 9 towards the edge 8. The right edge 9 has an angularly projecting lateral face 10, which spans a vertical edge of the glass element 45. At the edge 8, the front face 7 tapers to an apex due to the greater curvature, so that a direct glass support is formed there. The lateral face 5 is provided with a recess 14 at the edge of the glass, through which the elements connecting the functional inserts 44, e.g., in the form of a bearing pin 53, are connected.

Between the front face 7, the lateral faces 5 and 6, and the edges 8 and 9, a receiving chamber 54 is formed on the inside, under which the base 43 completely disappears after assembly. The lateral face 5 has two grooves 55 spaced some distance apart on the inside. The lateral face 6 is penetrated by two openings 56 spaced some distance apart.

Before the substructure 42 is mounted on the glass element 45, locking elements 57 in the form of grooved pins are driven into the bores 52, so that they are frictionally engaged. In accordance with an embodiment that is not shown in the drawings, the locking elements 57 can be formed on the substructure 42 as a single piece during manufacture. After the subsequent mounting of the substructure 42, the lateral face 6 of the cover 4 is set obliquely on the longitudinal side 51 of the base 43, so that the openings 56 are engaged with the locking elements 57 to provide positive locking. In the subsequent tilting movement of the cover 4 in the direction of the glass element 45, the receiving chamber 54 is completely inverted over the substructure 42. During this operation, the pins 50 are pushed back into their blind holes 47 by the action of the springs. Under the action of the springs 49, when the appropriate final alignment of the cover 4 is achieved, the pins 50 are pressed into the corresponding grooves 55. In this position, the cover 4 is fixed for the time being. The procedures described above are carried out on both sides of the glass element.

A possible disassembly is carried out in the reverse order. In this case, the cover is pushed as far as possible in the spring-relieving vertical direction, so that the grooves 55 and pins 50 can then be disengaged under a slight tensile load by swinging away the cover 4. On the lateral face 6, the connection between the openings 56 and the locking elements 57 can then be broken by simple vertical movement of the cover 4.

What is claimed is:

1. A fitting for mounting on a glass element, said fitting comprising two fitting halves, each said fitting half comprising:

a substructure for mounting on the glass element; and a cover that fits over the substructure, said cover having a pair of opposed lateral faces, a pair of opposed edges, and a front face that extends between said lateral faces and runs with a convex curvature between said opposed edges.

2. A fitting as in claim 1 wherein said fitting is a lock fitting which interacts with an opposing fitting, said lock fitting comprising at least one lock fitted to said substructures, each said front face having at least one of a projection and an opening associated with said lock.

3. A fitting as in claim 1 wherein said curvature is uniform.

4. A fitting as in claim 1 wherein at least one of said edges comprises a curved outer surface.

5. A fitting as in claim 1 wherein each said cover tapers to an apex at least one of said edges.

6. A fitting as in claim 1 wherein at least one of said lateral faces of each said cover comprises extensions.

7. A fitting as in claim 1 wherein each said lateral face is formed with at least one recess extending toward said front face.

8. A fitting as in claim 1 wherein each said cover has a substantially rectangle outline bounded by said lateral faces and said edges.

9. A fitting as in claim 1 wherein said cover has an L-shaped outline.

10. A fitting as in claim 1 wherein each said cover rests at least partially flat on the respective substructure.

11. A fitting as in claim 1 wherein said cover is selected from the group consisting of a metallic material, a plastic, and a hybrid material.

12. A fitting as in claim 1 wherein at least one of said substructures has at least two spaced apart outwardly directed locking elements which engage said cover inside of one of said lateral faces.

13. A fitting as in claim 12 wherein said at least one of said substructures has bores which receive respective said locking elements.

14. A fitting as in claim 12 wherein each said substructure has opposed longitudinal sides adjacent to respective lateral faces of the respective said cover, said blind holes and said locking elements being located on respective longitudinal sides, said blind holes being axially aligned with said locking elements.

15. A fitting as in claim 12 wherein said cover has at least one inward facing groove which is engaged by said stepped pins.

16. A fitting as in claim 15 wherein said cover has at least two openings.

17. A fitting as in claim 16 wherein said openings receive respective said locking elements.

18. A fitting as in claim 16 wherein said cover has a substantially rectangular profile, said grooves and said openings being located on opposite said lateral faces of said cover.

19. A fitting as in claim 1 wherein each said substructure comprises a base and a functional insert.

20. A fitting as in claim 1 wherein said fitting halves are mirror symmetric.

21. A fitting as in claim 2, further comprising at least one of a handle and a lock fitted in at least one of said substructures.

22. A fitting as in claim 2 wherein said lateral faces are horizontal and said edges are vertical when said fitting is mounted on said glass element.

23. A fitting as in claim 2 wherein said front face has a curvature which complements a curvature of a front face on said opposing fitting to form a complete curve.

24. A fitting as in claim 21 comprising a handle having a grip and a connecting element mounted on said grip with non-positive locking, wherein said grip is convexly curved and inwardly sloped and has a round cross-section.

25. A fitting as in claim 24 wherein said grip has a non-uniform convex curvature.

26. A fitting as in claim 24 wherein said grip has a free end which is not angled.

27. A fitting as in claim 24 wherein said grip has a free end with an inclined end face.

28. A fitting as in claim 27 wherein said end face has one of radii and bevels.

29. A fitting as in claim 24 wherein said connecting element has a round cross-section.

30. A fitting as in claim 24 wherein said connecting element has a diameter which increase, starting at said grip.

31. A fitting as in claim 24 wherein said grip and said connecting element consist of stainless steel.

32. A fitting as in claim 24 wherein said grip and said connecting element consist of bronze.

33. A fitting as in claim 24 wherein said grip and said connecting element consist of brass.

34. A fitting as in claim 24 wherein said grip and said connecting element consist of aluminum.

35. A fitting as in claim 24 wherein said grip and said connecting element consist of precision castings.

36. A fitting as in claim 24 wherein said grip and said connecting element consist of compression castings.

37. A fitting as in claim 24 wherein said handle can be mounted on at least one side of a pivotable element comprising one of a door element and a window element.

38. A fitting as in claim 24 wherein said handle can be mounted in integted form in said fitting halves and said opposing fitting.

* * * * *